US007975974B2

(12) United States Patent
Schaefer et al.

(10) Patent No.: US 7,975,974 B2
(45) Date of Patent: Jul. 12, 2011

(54) ADJUSTABLE LAMP

(75) Inventors: Roger A. Schaefer, Columbus, IN (US); Robert L. King, Seymour, IN (US); Marcus M. Hess, Brownstown, IN (US)

(73) Assignee: Valeo Sylvania LLC, Seymour, IN (US)

( * ) Notice: Subject to any disclaimer, the term of this patent is extended or adjusted under 35 U.S.C. 154(b) by 292 days.

(21) Appl. No.: 12/328,072

(22) Filed: Dec. 4, 2008

(65) Prior Publication Data

US 2010/0140432 A1 Jun. 10, 2010

(51) Int. Cl.
*E04G 3/00* (2006.01)

(52) U.S. Cl. ..... 248/274.1

(58) Field of Classification Search ..... 248/274.1, 248/278.1, 284.1, 289.11, 291.1, 292.14, 248/476, 481, 288.31; 362/273, 274
See application file for complete search history.

(56) References Cited

U.S. PATENT DOCUMENTS

| | | | | |
|---|---|---|---|---|
| 5,214,971 | A * | 6/1993 | Burton et al. | 74/89.13 |
| 5,267,128 | A | 11/1993 | Shamir | |
| 5,530,629 | A * | 6/1996 | Uehara | 362/528 |
| 6,974,231 | B2 | 12/2005 | Burton | |
| 7,150,541 | B2 * | 12/2006 | Burton | 362/273 |
| 7,264,376 | B2 | 9/2007 | Burton | |

* cited by examiner

*Primary Examiner* — Ramon O Ramirez
(74) *Attorney, Agent, or Firm* — Edward S. Podszus

(57) ABSTRACT

An adjustable lamp holder has a mounting structure arrayed about a longitudinal axis. A pair of hollow pivot pillars extends from the mounting structure parallel to the longitudinal axis and a receptacle is positioned on the mounting structure parallel to the longitudinal axis and substantially opposite the pivot pillars. A body with a body axis coaxial with the longitudinal axis has a pair of pivots formed thereon for engaging the pivot pillars. A projection is formed on the body substantially opposite the pivots and an angle adjuster, having a proximal end and a distal end, has the proximal end positioned in the projection and the distal end positioned in the receptacle. Movement of the angle adjuster tips the angle of the lamp.

8 Claims, 2 Drawing Sheets

ADJUSTABLE LAMP

CROSS-REFERENCE TO RELATED APPLICATIONS

Not applicable

BACKGROUND OF THE INVENTION

1. Field of the Invention

This invention relates generally to a pivoting mounting useful for a facia mounted fog lamp assembly for automobiles.

2. Description of the Related Art Including Information Disclosed Under 37 CFR 1.97 and 1.98

Many modem automobiles have a plastic ornamental facia covering the front bumper. The facia is sometimes formed with sockets for receiving fog lamps. Typically, the fog lamps are mounted in the sockets by screws threaded into plastic bosses on the facia. However, this arrangement makes installation and removal of the fog lamps difficult and in addition; the screw threads in the bosses have a tendency to strip, particularly after servicing.

Attempts to remedy these failures have led to mount structures involving extended pins riding in U-shaped slots that allow a reflector to pivot slightly. These structures, too, have been difficult to maintain and to service and, additionally, have usually required custom installation for each different vehicle with which they were to be utilized.

BRIEF SUMMARY OF THE INVENTION

It is, therefore, an object of the invention to obviate the disadvantages of the prior art. It is another object of the invention to improve the mounting systems for such lights. It is yet another object of the invention to enhance such mounting systems. These objects are accomplished, in one aspect of the invention, by the provision of an adjustable lamp holder comprising: a mounting structure arrayed about a longitudinal axis; a pair of hollow pivot pillars extending from said mounting structure parallel to said longitudinal axis; a receptacle positioned on said mounting structure parallel to said longitudinal axis and substantially opposite said pivot pillars; a body with a body axis coaxial with said longitudinal axis; a pair of pivots formed on said body engaging said pair of pivot pillars; a projection formed on said body substantially opposite said pivots; and an angle adjuster having a proximal end and a distal end, said proximal end being positioned in said projection and said distal end being positioned in said receptacle. In a preferred embodiment of the invention the pivot pillars are each provided with a latch receiver and each of the pivots is provided with a latch that engages the latch receiver. The system provides a universal pivoting assembly adaptable to many situations.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

Figure 1:
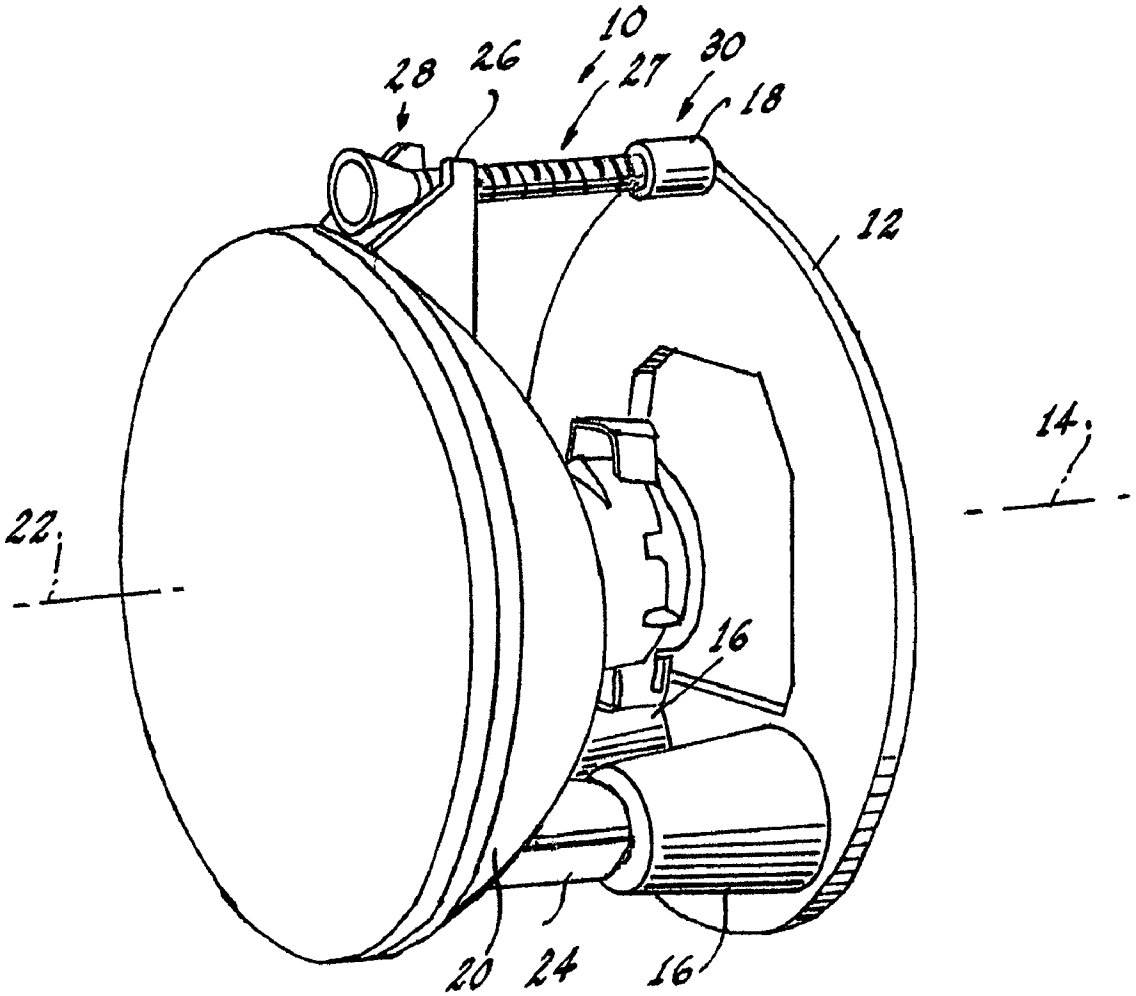
FIG. 1 is a perspective view of an embodiment of the invention.

FIG. 1 shows an adjustable lamp holder 10 comprising a mounting structure 12 arrayed about a longitudinal axis 14. The mounting structure 12 can comprise an elaborate base or a simple planar facia plate, as shown. A pair of hollow, pivot pillars 16 extend from the mounting structure 12 parallel to the longitudinal axis 14.

A threaded receptacle 18 is positioned on the mounting structure 12 parallel to the longitudinal axis 14 and substantially opposite the pair of hollow pivot pillars 16.

A body 20 has a body axis 22 coaxial with the longitudinal axis 14 and contains a light source, LS, of any suitable type, and has a pair of pivots 24 formed thereon for engaging the pivot pillars 16. A projection 26 is formed on the body 20 at a point substantially opposite the pivots 24. An angle adjuster 27 which may be in the form of a threaded shaft has a proximal end 28 and a distal end 30, the proximal end 28 being positioned in the projection 26 and the distal end 30 being positioned in the receptacle 18.

Figure 3:
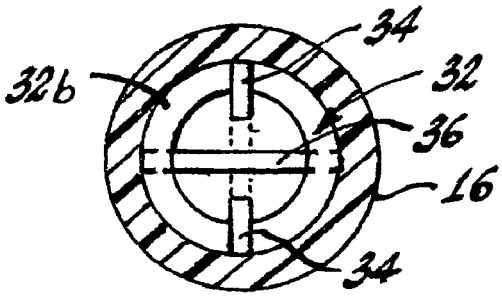
FIG. 3 is a sectional view taken along the line 3-3 of FIG. 2.

The pivot pillars 16 are each provided with a latch receiver 32, in this instance in the form of an annular ledge 32*a*, and each of the pivots 24, which are cruciform in cross-section, is provided with a pair of oppositely disposed flexible latches 34 that engage the latch receivers 32 by hooking under the ledge 32*a*, as shown in FIG. 3. The preferred latches 34 have knife edges to enhance pivoting along the face of ledge 32*a*.

Figure 2:
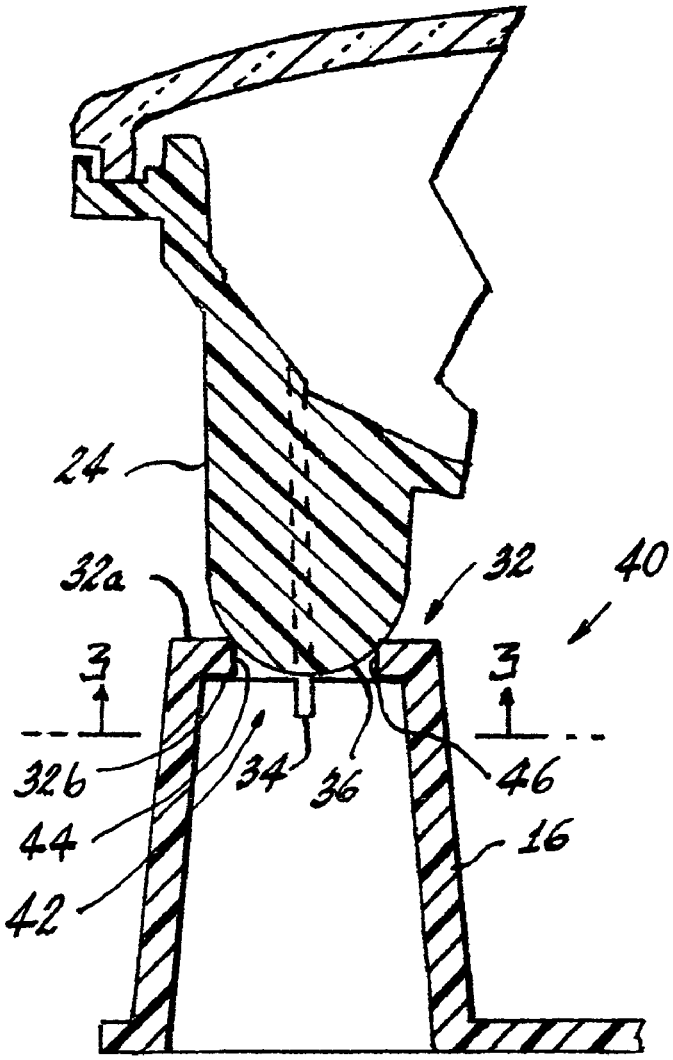
FIG. 2 is a partial sectional view illustrating the pivot.

The arm of the pivots transverse to the latches 34 (flexible arm) is provided with a pivot surface 36, having at least a section of a circle that can ride or roll smoothly on a bearing face formed on or about the outer end of or the radially inner edge of the annular ledge 32*a*, as is more clearly seen in FIG. 2.

The lamp structure may be assembled by aligning the body 20 with the mounting structure 12. The angle adjuster 27 (threaded shaft) is aligned with the receptacle 18. The pivots 24 are then pressed against the ends and or radially interior walls or sides of the latch receivers 32. By pressing further, the flexible latches 34 flex radially inward, and slide over the inner sides of the respective retention walls 32. Latches 34 spring outward once the latches 34 have passed over the retaining ledges 32*a*, hooking and holding the body 20 to the mounting structure 12. Simultaneously, the pivot surfaces 36 seat on the bearing surfaces formed on the retention wall, latch receivers 32. The pivot 24 is then hooked in place by the latches 34. The latches 34 may have approximately knife edges, on which the latches 34 may rock or pivot. At the same time the circular face of the pivot surface 36 may slide (roll) along the bearing face formed on the end or interior of the latch receivers 32. In this way the lamp assembly may be clipped into position on a vehicle facia, aimed by pivoting to a desired location and fixed by setting the threaded shaft. The mounting structure 12 can be formed from any suitable material such, for example, as nylon, polyethylene or ABS materials. The body 20, likewise, can be formed from a range of materials suitable to the environment of an automotive vehicle.

A preferred pivot assembly 40 has a pivot pillar 16 and a pivot 24. The pivot pillar 16 is formed with a latch receiver 32 having an axial recess 42 formed with at least two diametrically opposed inward facing ledge portions 44, 46 and at least two diametrically opposed bearing faces 32*a*, 32*b* that are positioned 90 degrees around the axis to the at least two diametrically opposed inward facing ledge portions 44, 46. The pivot 24 is formed with two diametrically opposed outwardly facing (radially away from the axis) but inwardly (radially towards the axis) flexible latches 34 that mate with the inward facing ledge portions 32*b* of the pivot pillar 16. The pivot 24 also has at least one bearing face 36 positioned 90 degrees around the axis to the flexible latches 34 that is sized and positioned to slidingly mate with the opposed bearing faces 32*a* formed on the pivot pillar 16.

The alignment of the lamp is adjusted by the movement of the angle adjuster 27. The adjustable lamp holder provided herein has many advantages over those of the prior art. The positive attachment caused by the latches 34 engaging the underside of the ledge 32*a* promotes a stable condition that holds up well to multiple adjustments and avoids the problems encountered by prior devices.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. An adjustable lamp holder (10) comprising:

a mounting structure (12) arrayed about a longitudinal axis (14);

a pair of hollow pivot pillars (16) extending from said mounting structure (12) parallel to said longitudinal axis (14);

a receptacle (18) positioned on said mounting structure (12) parallel to said longitudinal axis (14) and substantially opposite said pivot pillar (16);

a body (20) with a body axis (22) coaxial with said longitudinal axis (14);

a pair of pivots (24) formed on said body (20) engaging said pivot pillars (16);

a projection (26) formed on said body (20) substantially opposite said pivot (24);

an angle adjuster (27) having a proximal end (28) and a distal end (30), said proximal end (28) being positioned in said projection (26) and said distal end (30) being positioned in said receptacle (18); and wherein the pivot pillars (16) are each formed with a latch receiver (32) having an axial recess (42) formed with at least two diametrically opposed inward facing ledge portions (44, 46) and at least two diametrically opposed bearing faces (32*a*, 32*b*) positioned 90 degrees around the axis to the at least two diametrically opposed inwardly facing ledge portions (44, 46); and the pivots (24) are each formed with two diametrically opposed outwardly facing (radially away from the axis) but inwardly (radially towards the axis) flexible latches (34) mating with the inward facing ledge portions (32*b*) of each of the pivot pillars (16), and at least one bearing face (36) positioned 90 degrees around the axis to the flexible latches (34) sized and positioned to slidingly mate with the opposed bearing face (32*a*) of the respective pivot pillar (16).

2. The adjustable lamp holder (10) of claim 1 wherein said two pivot pillars (16) are laterally displaced one from the other.

3. The adjustable lamp holder (10) of claim 2 wherein said pivot pillars (16) are each provided with a latch receiver (32) and each of said pivots (24) is provided with a latch (34) that engages said latch receivers (32).

4. The adjustable lamp holder (10) of claim 1 wherein on each of said pivots (24) said latch (34) extends transverse to said pivot surface (36).

5. A pivot assembly (40) comprising:

a pivot pillar (16) formed with a latch receiver (32) having an axial recess (42) formed with at leas two diametrically opposed inward facing ledge portions (44, 46) and at least two diametrically opposed bearing faces (32*a*, 32*b*) positioned 90 degrees around the axis to the at least two diametrically inwardly facing ledge portions (44, 46);

a pivot (24) formed with, two diametrically opposed outwardly facing (radially away from the axis) but inwardly (radially towards the axis) flexible latches (34) mating with the inward facing ledge portions (32*b*) of the pivot pillar (16), and at least one bearing face (36) positioned 90 degrees around the axis to the flexible latches (34) sized and positioned to slidingly mate with the opposed bearing face (32*a*) of the pivot pillar (16).

6. The pivot assembly (40) of claim 5, wherein the latch receiver (32) has a circular end opening and the inwardly facing ledge portions (44, 46) extend circularly around the recess.

7. The pivot assembly (40) of claim 5, wherein the latches (34) include knife edges extending radially away from the axis and in pivotal contact with the inwardly facing ledge (44, 46).

8. The pivot assembly (40) of claim 5, wherein the bearing face (36) has at least a portion of a circular face that rides on a wall portion bearing face (32*a*) forming the opening to the axial recess (42).

* * * * *